US005546606A

United States Patent [19]

Luckabaugh

[11] Patent Number: 5,546,606

[45] Date of Patent: Aug. 20, 1996

[54] ADJUSTABLE BRIDAL TRAIN

[76] Inventor: Thelma J. Luckabaugh, 1718 Harvey Yingling Rd., Manchester, Md. 21102

[21] Appl. No.: 351,941

[22] Filed: Dec. 8, 1994

Related U.S. Application Data

[63] Continuation-in-part of Ser. No. 4,891, Feb. 16, 1993, abandoned.

[51] Int. Cl.[6] ..... A41D 1/14

[52] U.S. Cl. ..... 2/217; 2/211

[58] Field of Search ..... 2/217, 211, 210, 2/74, 75, 105, 125, 126, 269

[56] References Cited

U.S. PATENT DOCUMENTS

| | | | |
|---|---|---|---|
| D. 279,831 | 7/1985 | Hensel . | |
| 709,862 | 9/1902 | Baughman | 2/217 |
| 724,758 | 4/1903 | Todd | 2/217 |
| 2,687,530 | 8/1954 | Farnum | 2/217 |
| 2,692,988 | 11/1954 | Rouse | 2/217 |
| 3,064,268 | 11/1962 | Nania, Jr. | 2/217 |
| 3,165,755 | 1/1965 | Graham | 2/217 |
| 4,332,033 | 6/1982 | Frank . | |
| 4,774,726 | 10/1988 | Garrett . | |
| 4,879,767 | 11/1989 | Hart . | |
| 5,052,059 | 10/1991 | Speer . | |

*Primary Examiner*—C. D. Crowder
*Assistant Examiner*—Gloria Hale

[57] ABSTRACT

A bridal train for adjustably positioning relative to a ground surface. The inventive device includes a skirt web forming a portion of a bridal gown which continues into a train web for trailing behind the gown during a wedding proceeding. Retracting assemblies are secured to inner surfaces of the train web for effecting a pleating and shortening of the train web to a length substantially equal to a length of the skirt web so as to hang the train from the gown and preclude trailing of the train web along a ground surface.

4 Claims, 3 Drawing Sheets

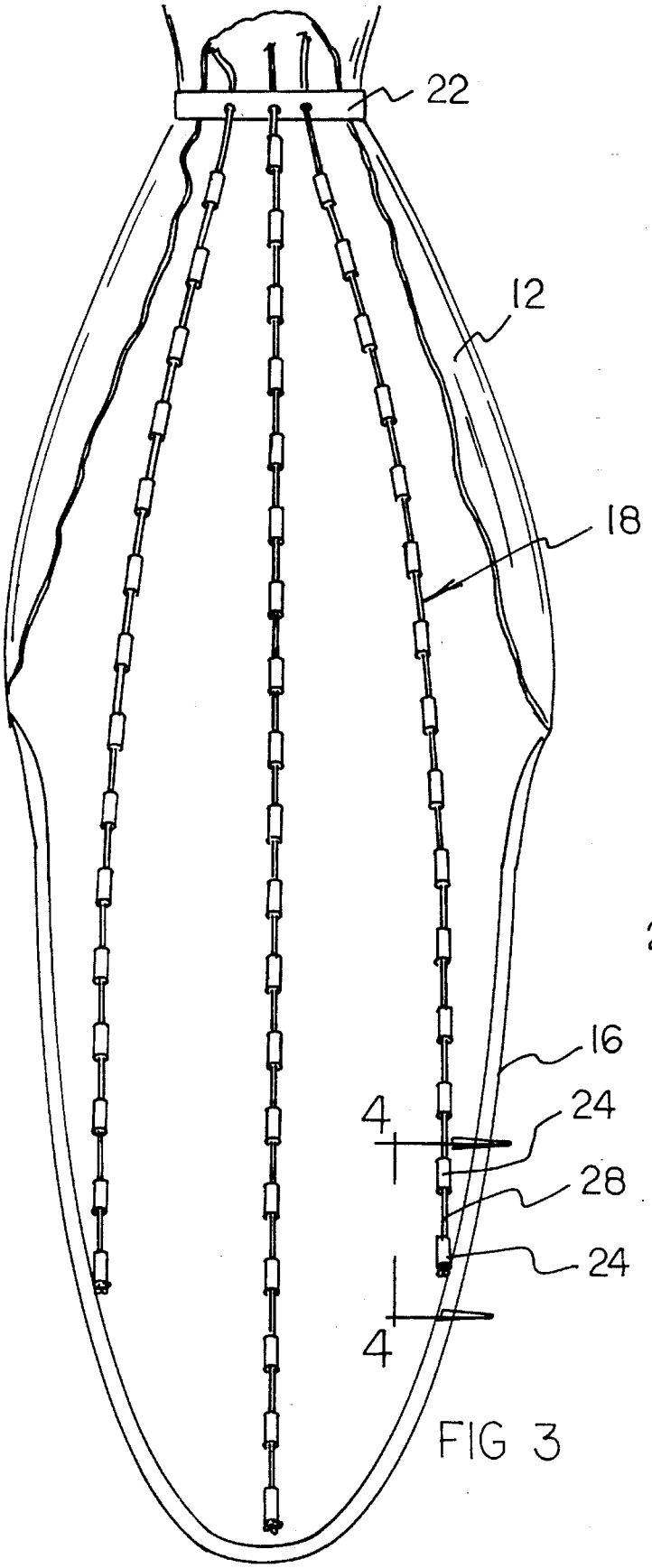
FIG 3
FIG 4
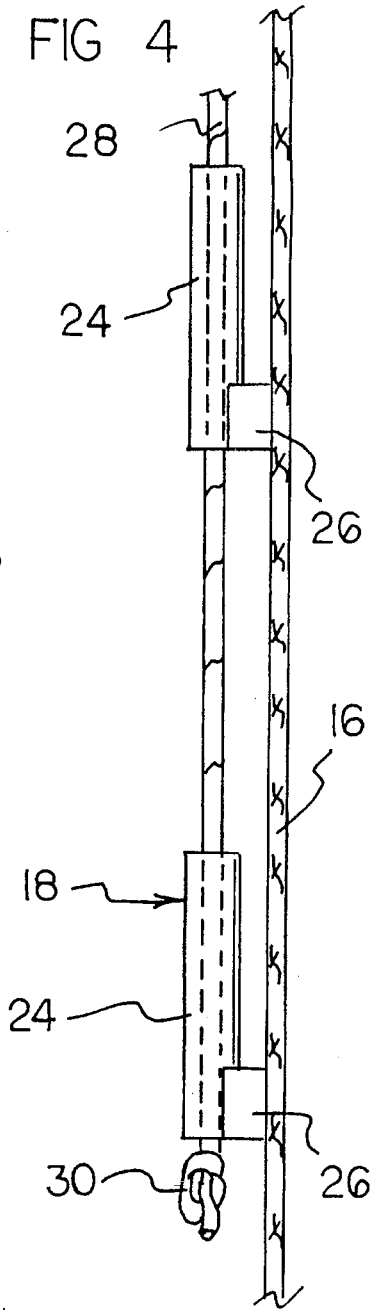

ADJUSTABLE BRIDAL TRAIN

Related Application

This application is a continuation-in-part of application Ser. No. 29/004,891, filed Feb. 16, 1993, now abandoned, or any continuation based thereon.

BACKGROUND OF THE INVENTION

FIELD OF THE INVENTION

The present invention relates to adjustable clothing devices and more particularly pertains to a bridal train for adjustably positioning relative to a ground surface.

DESCRIPTION OF THE PRIOR ART

The use of adjustable clothing devices is known in the prior art. More specifically, adjustable clothing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable clothing devices include U.S. Pat. Nos. 5,052,059; 4,879,767; 4,774,726; 4,332,033; and Des. No. 279,831.

While these devices fulfill their respective, particular objectives and requirements, the aforementioned patents do not disclose a bridal train for adjustably positioning relative to a ground surface which includes a skirt web forming a portion of a bridal gown which continues into a train web for trailing behind the gown during a wedding proceeding, and retracting assemblies are secured to inner surfaces of the train web for effecting a pleating and shortening of the train web to a length substantially equal to a length of the skirt web so as to hang the train from the gown and preclude trailing of the train web along a ground surface.

In these respects, the adjustable bridal train according to the present invention substantially departs from the conventional concepts and designs of the prior art, and in so doing provides an apparatus primarily developed for the purpose of adjustably positioning relative to a ground surface.

SUMMARY OF THE INVENTION

In view of the foregoing disadvantages inherent in the known types of adjustable clothing devices now present in the prior art, the present invention provides a new adjustable bridal train construction wherein the same can be utilized for adjustably positioning relative to a ground surface. As such, the general purpose of the present invention, which will be described subsequently in greater detail, is to provide a new adjustable bridal train apparatus and method which has many of the advantages of the adjustable clothing devices mentioned heretofore and many novel features that result in an adjustable bridal train which is not anticipated, rendered obvious, suggested, or even implied by any of the prior art adjustable clothing devices, either alone or in any combination thereof.

To attain this, the present invention generally comprises a bridal train for adjustable positioning relative to a ground surface. The inventive device includes a skirt web forming a portion of a bridal gown which continues into a train web for trailing behind the gown during a wedding proceeding. Retracting assemblies are secured to inner surfaces of the train web for effecting a pleating and shortening of the train web to a length substantially equal to a length of the skirt web so as to hang the train from the gown and preclude trailing of the train web along a ground surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable bridal train apparatus and method which has many of the advantages of the adjustable clothing devices mentioned heretofore and many novel features that result in an adjustable bridal train which is not anticipated, rendered obvious, suggested, or even implied by any of the prior art adjustable clothing devices, either alone or in any combination thereof.

It is another object of the present invention to provide a new adjustable bridal train which may be easily and efficiently manufactured and marketed.

It is a further object of the present invention to provide a new adjustable bridal train which is of a durable and reliable construction.

An even further object of the present invention is to provide a new adjustable bridal train which is susceptible of a low cost of manufacture with regard to both materials and labor, and which accordingly is then susceptible of low prices of sale to the consuming public, thereby making such adjustable bridal trains economically available to the buying public.

Still yet another object of the present invention is to provide a new adjustable bridal train which provides in the apparatuses and methods of the prior art some of the advantages thereof, while simultaneously overcoming some of the disadvantages normally associated therewith.

Still another object of the present invention is to provide a new adjustable bridal train for adjustably positioning relative to a ground surface.

Yet another object of the present invention is to provide a new adjustable bridal train which includes a skirt web forming a portion of a bridal gown which continues into a train web for trailing behind the gown during a wedding proceeding, and retracting assemblies are secured to inner surfaces of the train web for effecting a pleating and shortening of the train web to a length substantially equal to a length of the skirt web so as to hang the train from the gown and preclude trailing of the train web along a ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an elevation view of an interior of the invention.

FIG. 4 is a cross sectional view taken along line 4—4 of FIG. 3.

DESCRIPTION OF THE PREFERRED EMBODIMENT

Figure 1:
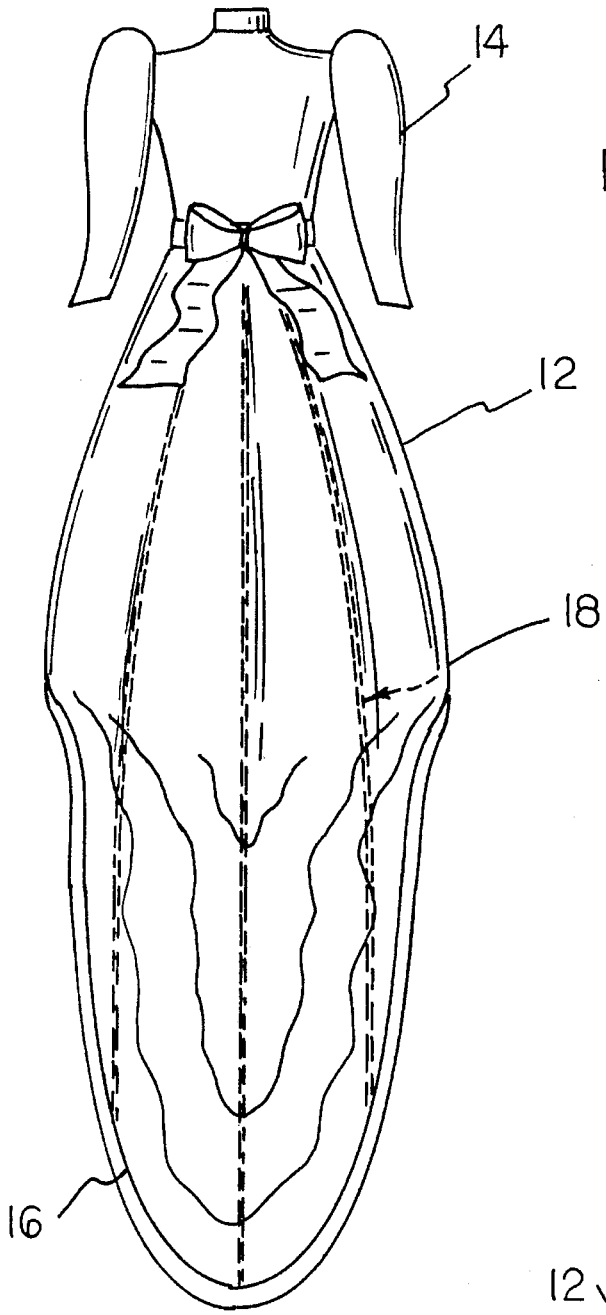
FIG. 1 is a rear elevation view of an adjustable bridal train according to the present invention in an extended position.

With reference now to the drawings, and in particular to FIGS. 1—6 thereof, a new adjustable bridal train embodying the principles and concepts of the present invention and generally designated by the reference numeral 10 will be described.

Figure 2:
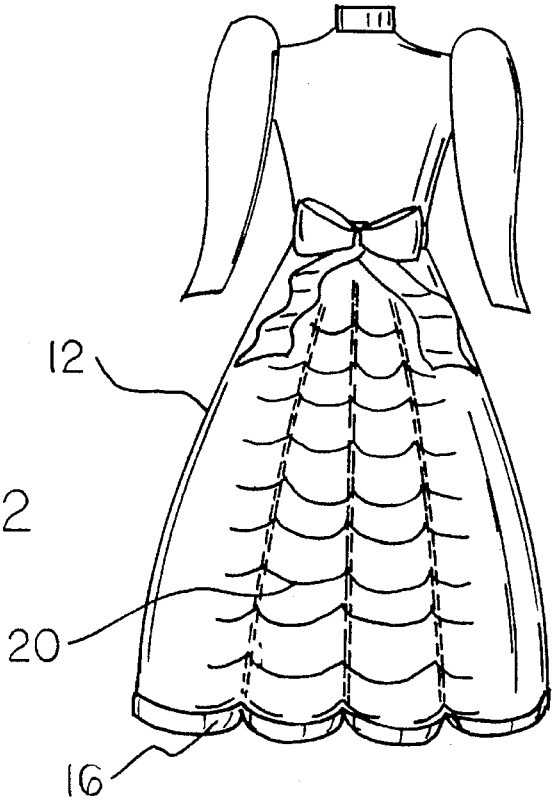
FIG. 2 is a rear elevation view of the adjustable bridal train in a retracted position.

More specifically, it will be noted that the adjustable bridal train 10 comprises a skirt web 12 forming a portion of a gown 14, such as the bridal gown illustrated in the figures. A train web 16 extends from the gown 14 and is configured to extend beyond the skirt web 12 so as to trail behind an individual wearing the gown 14, as shown in FIG. 1. A plurality of retracting means 18 are coupled to an interior surface of the train web 16 for folding the train web into a plurality of pleats 20 and for shortening the train web to a length substantially equal to a length of the skirt web 12 such that the train web hangs from the gown 14 without trailing along a ground surface beneath the gown, as shown in FIG. 2. By this structure, a bride can easily retract the train web 16 to facilitate increased mobility of the associated gown 14 during post-wedding activities.

As shown in FIGS. 3 and 4, the skirt web 12 hangs downwardly from a waistline 22 of the gown 14 and may integrally continue into the train web 16. Alternatively, the train web 16 can be a separate web from the skirt web 12 with the same results of the present invention 10 being retained.

With continuing reference to these FIGS. 3 and 4, it can be shown that the retracting means 18 according to the present invention 10 each comprise a plurality of flexible guide tubes 24 secured to an interior surface of the train web 16 in a substantially spaced and colinear orientation to one another. To this end, each of the flexible guide tubes 24 includes a mounting projection 26 extending from a first end thereof which is coupled to the interior surface of the train web 16 by stitching, adhesive, or other conventionally know fastening means. A second end of each of the flexible guide tubes 24 hangs free relative to the train web 16 to permit pleating of the train web into the configuration illustrated in FIG. 6 in a manner which will subsequently be described in more detail. A flexible cord 28 extends through the aligned flexible guide tubes 24 and is coupled to a lowermost one thereof by a knot 30 or other coupling means securing the cord thereto. By this structure, a retracting of the cord 28 through the guide tubes 24 will draw the train web 16 into the pleated configuration illustrated in FIG. 6 to form the plurality of pleats therein as also shown in FIG. 2. Such pleated configuration of the train web 16 is formed as adjacent guide tubes 24 abut to form a continuous length of abutting guide tubes with the cord 28 extending therethrough. Because the guide tubes 24 are substantially flexible in construction, the same are permitted to flex with the train web 16 during dancing and like activities.

Preferably, the present invention employs three of the retracting means 18 equally transversely spaced and extending longitudinally along a length of the train web 16 from the waistline 22 of the gown 14. If desired, the cords 28 of such retracting assemblies can be routed through the waistline for operation by the individual wearing the gown 14. Preferably, the cords 28 remain hidden at all times and can be provided with suitable securing means for bundling and securing the excess cord beneath the gown 14.

Figure 5:
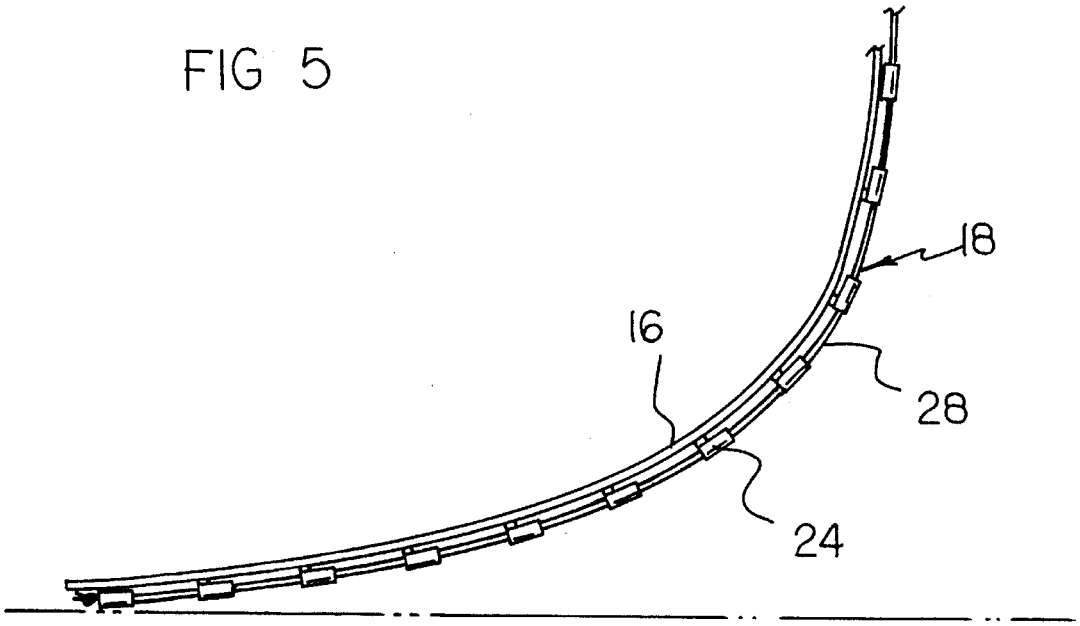
FIG. 5 is a cross sectional view of a train web in the extended position.
Figure 6:
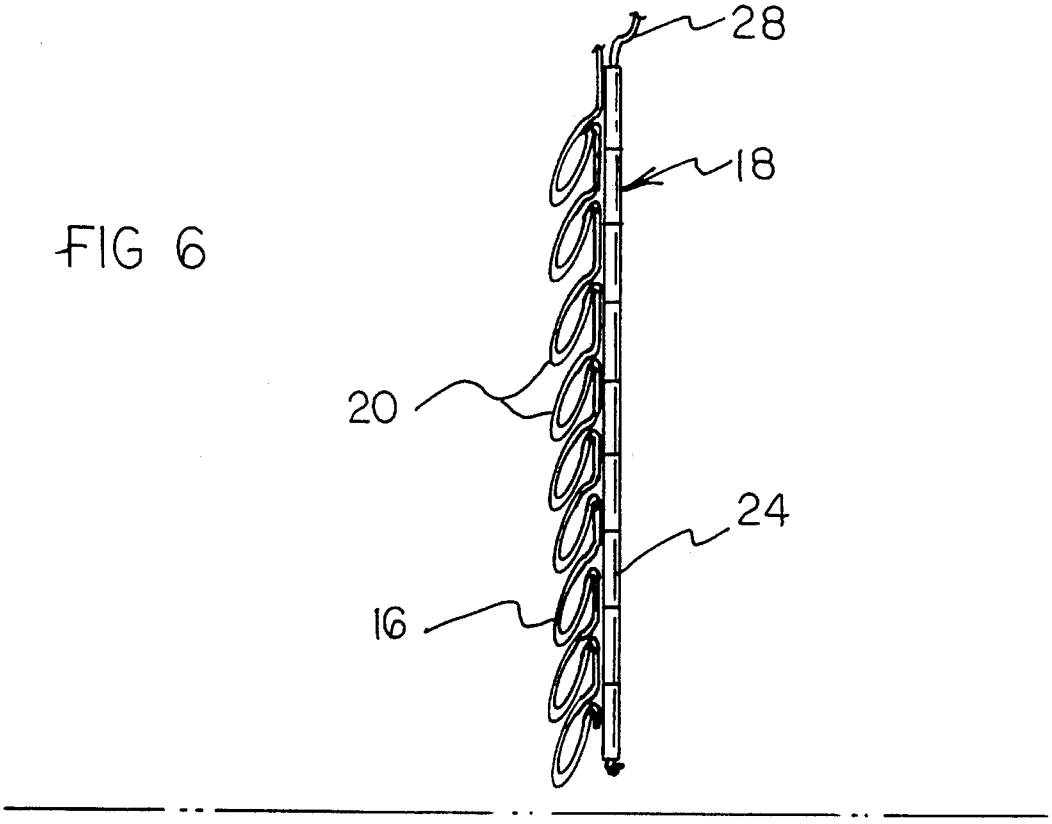
FIG. 6 is a cross sectional view of the train web in the retracted position.

In use, the present invention 10 can be easily incorporated into the train web 16 of a wedding gown 14 such as illustrated in FIG. 1. During use of the gown 14 in a wedding, the train web 16 can be positioned so as to extend behind the bride to drag across a ground surface such as illustrated in FIG. 5. Subsequent to the wedding and prior to the reception, the cords 28 of the retracting means 18 can be drawn to effect retraction of the train web 16 into the configuration illustrated in FIG. 6, wherein the train is folded into a plurality of aesthetically pleasing pleats 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable bridal train comprising:

a skirt web for forming a portion of a gown;

a train web extending from the gown and configured to extend beyond the skirt web so as to trail behind an individual wearing the gown;

and, a retracting means coupled to an interior surface of the train web for shortening the train web to a length substantially equal to a length of the skirt web such that the train web hangs from the gown without trailing along a ground surface beneath the gown, wherein the retracting means also operates for folding the train web into a plurality of pleats, and wherein the retracting means comprises a plurality of flexible guide tubes secured to an interior surface of the train web in a substantially spaced and colinear orientation to one another; and a flexible cord extending through the aligned flexible guide tubes and being coupled to a lowermost one of the guide tube, wherein a retracting of the cord through the guide tubes will draw the train web into a shortened configuration.

2. The adjustable bridal train of claim 1, wherein each of the flexible guide tubes includes a mounting projection extending from a first end thereof which is coupled to the interior surface of the train web, with a second end of each of the flexible guide tubes hanging free relative to the train web to permit pleating of the train web during retraction of the cord from the guide tubes.

3. The adjustable bridal train of claim 2, wherein the present invention includes three of the retracting means equally transversely spaced and extending longitudinally along a length of the train web from a waistline of the gown.

4. The adjustable bridal train of claim 3, wherein the cords of the retracting means are routed through the waistline of the gown.

* * * * *